US005666135A

United States Patent [19]

Taki

[11] Patent Number: 5,666,135

[45] Date of Patent: Sep. 9, 1997

[54] ELECTRONIC EQUIPMENT HAVING DISPLAY DEVICE IN WHICH A SHARED MEMORY IS ACCESSED BY BOTH THE SYSTEM AND DISPLAY CONTROLLERS VIA A DATA BUS

[75] Inventor: Ryoji Taki, Konan, Japan

[73] Assignee: Brother Kogyo Kabushiki Kaisha, Nagoya, Japan

[21] Appl. No.: 392,185

[22] Filed: Feb. 22, 1995

[30] Foreign Application Priority Data

Feb. 25, 1994 [JP] Japan ..... 6-028260

[51] Int. Cl.[6] ..... G09G 5/00

[52] U.S. Cl. ..... 345/112; 345/185; 345/200; 345/27

[58] Field of Search ..... 345/112, 133, 345/141, 143, 150, 185, 186, 188, 189, 190, 191, 192, 193, 194, 195, 200; 395/10, 834, 842, 856, 860, 871, 287, 288, 296, 311, 312, 401, 474, 477, 478, 479, 480

[56] References Cited

U.S. PATENT DOCUMENTS 4,660,156 4/1987 Guttag et al. ..... 364/521

4,942,391 7/1990 Kikuta ..... 340/745

5,245,323 9/1993 Ichijo ..... 345/13

5,542,110 7/1996 Minagawa ..... 395/287

*Primary Examiner*—John K. Peng

*Assistant Examiner*—Nathan J. Flynn

*Attorney, Agent, or Firm*—Oliff & Berridge

[57] ABSTRACT

A piece of electronic equipment having a display device, the display control is allowed to read out the display data stored in the data storing means when detecting that the central processing unit (CPU) sets the data bus to a high-impedance state. Therefore, the CPU and the display control are inhibited from accessing the data storage at the same time, so that there is no case where erroneous data are read out from or written into or the display is disturbed. Accordingly, the operation data and the display data can be stored into a one-chip data storage. Further, since the data bus is periodically set to the high-impedance by the CPU, the CPU can accurately count a predetermined time with the soft timer program.

20 Claims, 4 Drawing Sheets

ELECTRONIC EQUIPMENT HAVING DISPLAY DEVICE IN WHICH A SHARED MEMORY IS ACCESSED BY BOTH THE SYSTEM AND DISPLAY CONTROLLERS VIA A DATA BUS

BACKGROUND OF THE INVENTION

1. Field of the Invention

The invention relates to a piece of electronic equipment having a display device, and particularly to a piece of electronic equipment having a display device in which display data and operation data are stored in a one-chip RAM and a soft timer program is usable.

2. Description of Related Art

A piece of electronic equipment having a display device, for example, a word processor having a CRT, a liquid crystal device (LCD) display or other type of display device has been conventionally equipped with a RAM having a text area for storing a work area which is used for data operation by a microprocessor unit (MPU) and document data, and a video RAM (V-RAM) provided as another separate chip which is designed independently of the RAM and serves to store only display data.

FIG. 4 is a block diagram showing a conventional word processor as described above. The conventional word processor 80 shown in FIG. 4 includes a display device 81, a keyboard 82, an external storage device 83, a print device 84 and a control device C8. The display device 81 comprises a liquid crystal device (LCD) display 85 and an LCD controller 86 for controlling the display operation of the LCD display 85. The control device C8 comprises an MPU 96, a ROM 97, a RAM 98, a V-RAM 92, a timing control circuit 95, an input/output interface 93 and a bus line 94.

In the conventional word processor 80 thus structured, the access operation of the V-RAM 92 is carried out as follows.

First, the MPU 96 writes display data into the V-RAM 92 through the bus line 94 and the input/output interface 93. Further, the LCD controller 86 periodically reads out from the V-RAM 92 the display data which have been written by the MPU 96, and outputs the data to the LCD display 85 for display.

Since the MPU 96 and the LCD controller 86 are operated in asynchronism with each other, the MPU 96 and the LCD controller 86 may accidentally access the V-RAM 92 at the same time unless an access timing to the V-RAM 92 is controlled between the MPU 96 and the LCD controller 86 using a suitable means. Once such a case occurs, the MPU 96 may write or read erroneous data into or from the V-RAM 92, resulting in disturbance of the display operation of the LCD display 85. This is because when the V-RAM 92 is supplied with different addresses from the MPU 96 and the LCD controller 86, an erroneous address of the V-RAM 92 is accessed, or the write-in or read-out data of the MPU 96 for the V-RAM 92 are overlapped with read-out data which are read out from the V-RAM 92 by the LCD controller 86.

Therefore, a timing control circuit 95 is provided so that the access of the LCD controller 86 has priority over the access of the MPU 96 because the LCD controller 86 periodically accesses the V-RAM 92, whereby the MPU 96 and the LCD controller 86 are prevented from accessing the V-RAM 92 at the same time.

That is, when the MPU 96 needs access to the V-RAM 92, the MPU 96 first outputs to the timing control circuit 95 a signal indicating an access requirement thereof to the V-RAM 92. Upon input of the signal, the timing control circuit 95 checks the current status of the LCD controller 86. If the LCD controller 86 is reading out data from the V-RAM 92 at that time, the timing control circuit 95 outputs to the MPU 96 an access waiting signal which instructs the MPU 96 to wait for access to the V-RAM 96 until the read-out operation of the LCD controller 86 for the V-RAM 92 is completed. Upon receipt of the waiting signal, the MPU 96 waits for access to the V-RAM 92. When the read-out operation of the LCD controller 86 for the V-RAM 92 is completed, the timing control circuit 95 ceases the output of the waiting signal to the MPU 96. In response to the stopping of the waiting signal, the MPU 96 releases its waiting or standby state to carry out the read-out or write-in operation of new data for the V-RAM 92.

However, the conventional word processor 80, as described above, must be equipped with not only the RAM 98 for storing both the operation data and the document data, but also the V-RAM 92 for storing display data as a chip memory which is provided separately from the RAM 98. That is, two RAM chips must be provided, resulting in an increased cost of the device.

SUMMARY OF THE INVENTION

In order to reduce the cost, the V-RAM 92 may be built into the RAM 98 for storing the operation data and the document data, thereby reducing the number of the RAMs by one. However, in this case, the following problem occurs.

With respect to the conventional structure in which the V-RAM 92 and the RAM 98 are separately designed with two chips, the waiting signal is output from the timing control circuit 95 to the MPU 96 only when the access timing to the V-RAM 92 is overlapped between the MPU 96 and the LCD controller 86, that is, only when the access to the display data is overlapped between the LCD controller 86 and the MPU 96.

However, if the V-RAM 92 and the RAM 98 are designed in one chip, the waiting signal would be irregularly output to the MPU 96 even when an access of the operation data and the document data other than the display data is required to control the external storage device 83 or the print device 84. Therefore, not only is program execution speed (speed at which the program is executed) reduced, but also program execution time is not constant due to the irregular waiting signal output to the MPU 96. Therefore, when a time lapse is counted with a soft timer program which counts a time lapse on the basis of the frequency of execution of program commands, the time lapse which is counted with the soft timer program becomes inaccurate, and programs using the soft timer program are substantially unusable.

An object of the invention is to provide a piece of electronic equipment having a display device in which both the display data and the operation data can be stored in a one-chip storage means and a soft timer program can be used.

In order to attain the above object, a piece of electronic equipment having a display device according to the invention includes control means for executing various processing such as an operation processing, etc.; display means for displaying characters and symbols; data storing means for temporarily storing operation data used by the control means and display data of characters or figures which are displayed on the display means; and a data bus for connecting the control means and the data storing means to perform the write-in and read-out operation of the data stored in the data storing means, wherein the control means includes detection means for detecting that the control means sets the data bus to a high impedance state; and display control means which is connected through the data bus to the data storing means for reading out the display data stored in the data storing means in response to the detection of the high-impedance state of the data bus by the detection means, thereby controlling the display of the data on the display means.

Further, the electronic equipment having the display device according to the invention includes signal generating means for generating a signal periodically and a soft timer program for counting a predetermined time. The control means receives the signal from the signal generating means to set the data bus to a high-impedance state, and the predetermined time is counted by the soft timer program.

Still further, according to the piece of electronic equipment having the display device thus constructed, the signal generating means is built into the control means and the signal which is periodically generated by the signal generating means is constructed by a refresh signal of a dynamic RAM.

According to the piece of electronic equipment having the display device of the invention, when it is detected by the detection means that the control means sets the data bus to the high-impedance state, the display control means reads out the display data stored in the data storing means in response to the detection result to control the display of the data on the display means. On the other hand, the control means is inhibited from performing the read-out and write-in operations of data for the data storing means when the data bus is set to the high-impedance state, so that the control means and the display control means cannot access the data storing means at the same time.

Further, upon receiving the signal which is periodically generated from the signal generating means, the control means sets the data bus to the high-impedance state, and the high-impedance state is detected by the detection means. In response to the detection result, the display control means reads out the display data stored in the data storing means to control the display of the data on the display means when the data bus is set to the high-impedance state. On the other hand, the control means is set to the high-impedance state, so that the predetermined time can be accurately counted.

Still further, in response to the refresh signal of the dynamic RAM which is periodically generated, the control means sets the data bus to the high-impedance state. When the refresh signal is detected by the detection means, the display control means reads out the display data stored in the data storing means in response to the detection result to thereby control the display of the data on the display means. On the other hand, the control means is periodically set to the high-impedance state, so that the predetermined time can be accurately counted by the soft timer program.

As is apparent from the foregoing, according to the electronic equipment having the display device, the display control means is allowed to read out the display data stored in the data storing means when detecting that the control means has set the data bus to the high-impedance state. Therefore, the control means and the display control means are inhibited from accessing the data storing means at the same time, so that there is no case where erroneous data are read out or written in or the display is disturbed. Accordingly, the operation data and the display data can be stored in a one-chip data storing means.

That is, it is unnecessary to provide separate data storing means for a display. Thus, the cost of the data storing means can be reduced, the print board can be miniaturized and the cost of the electronic equipment can be reduced.

Further, since the data bus is periodically set to the high-impedance by the control means, the control means can accurately count a predetermined time with the soft timer program.

Still further, since the control means sets the data bus to the high-impedance state in response to the refresh signal of the dynamic RAM which is generated by the signal generating means built into the control means, no special circuit for generating a periodic signal is required and, thus, the electronic equipment can be simplified in construction.

BRIEF DESCRIPTION OF THE DRAWINGS

A preferred embodiment according to the invention will be described in detail with reference to the following figures wherein.

DETAILED DESCRIPTION OF THE PREFERRED EMBODIMENT

Figure 1:
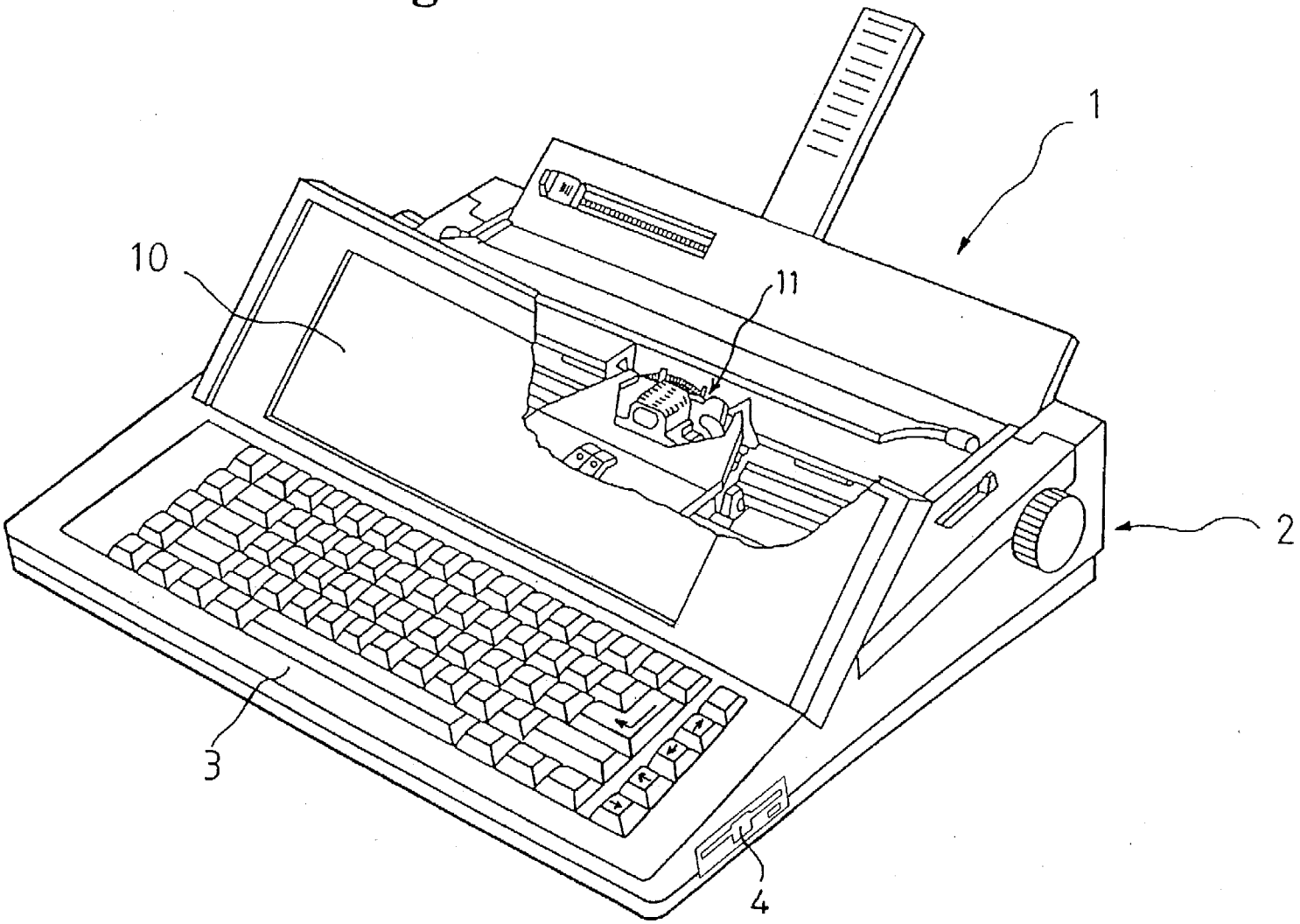
FIG. 1 is a perspective view of a word processor which is an embodiment of the invention.

The embodiment of the invention is described in the context of a word processor for English letters but is not limited thereby. FIG. 1 is a perspective view of the word processor 1 of the embodiment.

The word processor 1 has a keyboard 3 at the front side of a body frame 2. A daisy wheel type printer 11 is disposed behind the keyboard 3 and inside of the body frame 2, and a liquid crystal device (LCD) display 10, serving as a display means for displaying characters or symbols, is disposed between the keyboard 3 and the printer 11. Further, at the side surface of the body frame 2 is provided an insertion slit 4 through which a floppy disc (FD) 5 is inserted.

Figure 2:
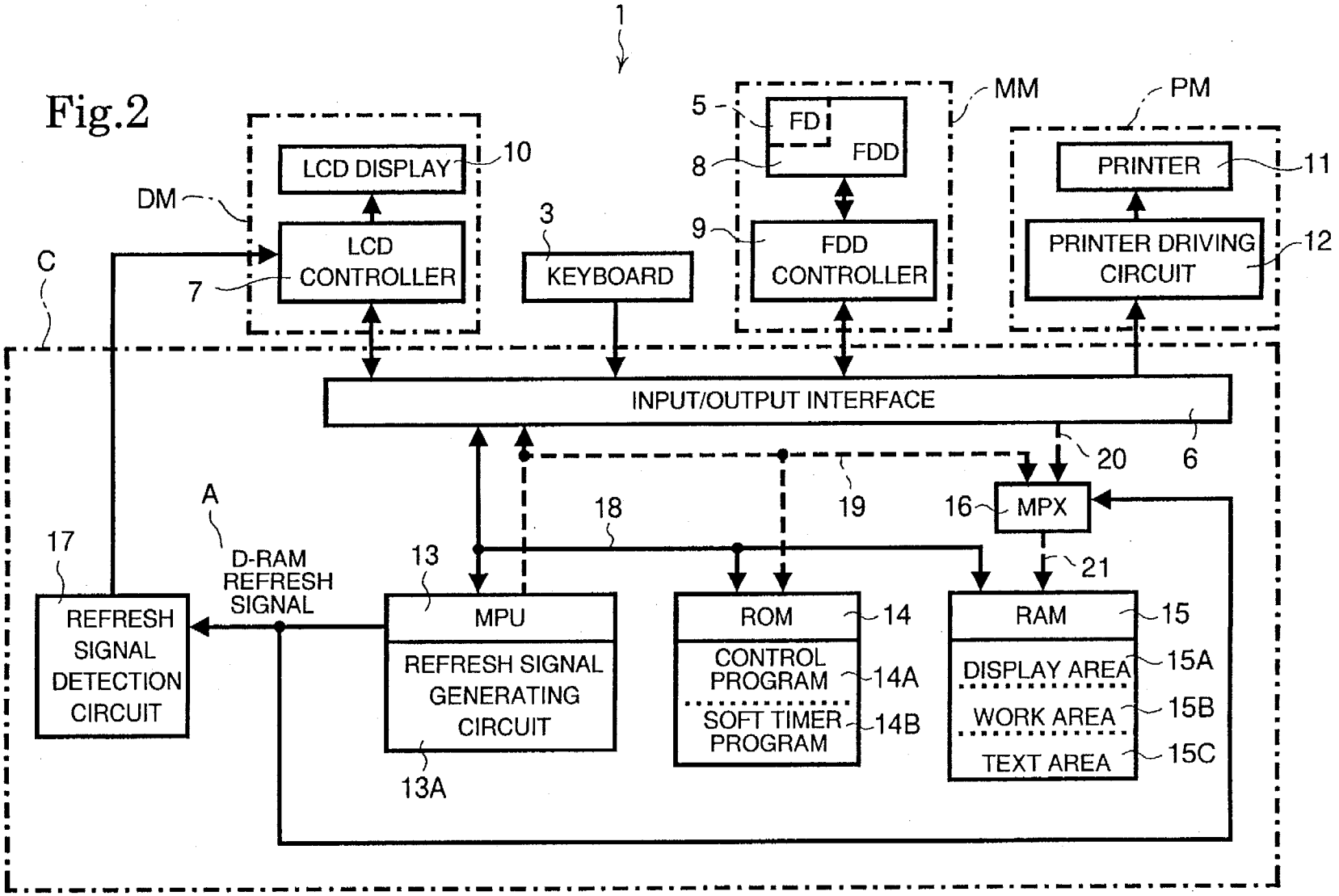
FIG. 2 is a block diagram showing a control system of a word processor.

A control system for the word processor thus structured is as shown in the block diagram of FIG. 2.

The word processor basically comprises the keyboard 3, a display device DM, an external storage device MM, a print device PM, and a controller C.

The display device DM includes the LCD display 10 for displaying English letters, etc. input from the keyboard 3 over plural lines and an LCD controller 7. The LCD controller 7 serves as a display control means for controlling the display of the LCD display 10. The LCD controller 7 periodically reads out from a display area 15A of the RAM 15 those display data which are written in the display area 15A by the microprocessor unit (MPU) 13, and outputs the read-out data to the LCD display 10 to perform the display control.

The external storage device MM includes a floppy disc (FD) 5 for storing a plurality of document data, a floppy disc driver (FDD) 8 for performing data read-out and write-in operations for the floppy disc 5, and a floppy disc driver (FDD) controller 9 for controlling the driving of the floppy disc driver 8. The print device PM includes a printer 11 for printing data on sheets and a printer driving circuit 12 for controlling the driving of the printer 11.

The keyboard 3, the LCD controller 7, the FDD controller 9 and the printer driving circuit 12 are connected to the input/output interface 6 of the controller C.

The controller C includes the MPU 13 serving as a control means, the input/output interface 6 which is connected to the MPU 13 through buses such as a data bus 18 and an address bus 19, a refresh signal detection circuit 17 serving as detection means for detecting generation of a refresh signal of the dynamic RAM (D-RAM), a ROM 14, a RAM 15 serving as data storage means, and a multiplexer (MPX) 16 for selectively switching an address signal to be output to the RAM 15.

The MPU 13 serves to execute various kinds of operations on the basis of programs stored in the ROM 14, to perform read-out and write-in operations for data stored in the RAM 15, and to control the display device DM, the external storage device MM, and the print device PM. The MPU 13 contains therein a refresh signal generating circuit 13A of a D-RAM which serves as signal generating means. The refresh signal generating circuit 13A periodically generates the refresh signal of the D-RAM on the basis of the setting of the MPU 13. In response to this signal, the MPU 13 periodically sets the data bus 18 to a high-impedance state to interrupt the execution of programs 14A, 14B stored in the ROM 14. The MPU 13 under a high-impedance state corresponds to such a state that it is substantially separated from the data bus 18, that is, a non-connection state to the data bus 18. The signal generated in the refresh signal generating circuit 13A is transmitted to each of the refresh signal detection circuit 17 and the multiplexer 16.

The ROM 14 is connected to the MPU 13 through the address bus 19 and the data bus 18. Various kinds of control programs 14A and a soft timer program 14B are stored in the ROM 14. Here, "soft timer program" is defined as a program which counts a predetermined time lapse on the basis of execution of the program. That is, a predetermined number of program commands are beforehand prepared to obtain (set) a desired time (lapse). If the desired time lapse is needed to be counted, the program is executed to count the desired time lapse on the basis of the detection of the execution of the predetermined number of commands. The soft timer program 14B is executed at the access time to the external storage device MM or the print device PM. An operation start timing for each device is detected by accurately counting the desired time.

The RAM 15 is directly connected to the MPU 13 through the data bus 18 while indirectly connected to the MPU 13 through the address bus 19 and the multiplexer 16.

The multiplexer 16 has two address input portions, one address output portion and one signal input portion. One address input portion of the multiplexer 16 is connected to the address bus 19 extending from the MPU 13, and the other address input portion is connected through the input/output interface 6 and the address bus 20 to the LCD controller 7. The address output portion of the multiplexer 16 is connected to the RAM 15 through the address bus 21. The signal input portion of the multiplexer 16 is supplied with the D-RAM refresh signal generated in the refresh signal generating circuit 13A of the MPU 13. The multiplexer 16 is designed to output the address of the LCD controller 7 to the RAM 15 while the D-RAM refresh signal is output, and output the address of the MPU 13 to the RAM 15 when no D-RAM refresh signal is output. Therefore, the address signals output from the MPU 13 and the LCD controller 7 are inhibited from being output to the RAM 15 at the same time (while overlapped with each other).

The MPU 13 of this embodiment can set the data bus 18 to the high-impedance state, however, it cannot set the address bus 19 to the high-impedance state. Therefore, with respect to the address buses 19, 20 and 21, the MPU 13 is indirectly connected through the multiplexer 16 to the RAM 15.

The RAM 15 is provided with different areas for storing different types of data, such as a display area 15A for storing display data, a work area 15B for storing operation data used by the MPU 13, and a text area 15C for storing document data. The display data stored in the display area 15A are written by the MPU 13 and periodically read out by the LCD controller 7 to be displayed on the LCD display 10.

The refresh signal detection circuit 17 detects the refresh signal of the D-RAM which is output from the refresh signal generating circuit 13A, and outputs the signal to the LCD controller 7. The LCD controller 7 is designed to access the RAM 15 only while it receives the detection signal. The MPU 13 keeps the data bus 18 in the high-impedance state while the refresh signal of the D-RAM is output therefrom, thereby interrupting the execution of the programs 14A, 14B. Accordingly, if the LCD controller 7 accesses the RAM 15 during only this period, the MPU 13 and the LCD controller 7 cannot access the RAM 15 at the same time. Since the refresh signal detection circuit 17 detects the D-RAM refresh signal on the basis of its pulse trailing edge, the high-impedance state of the MPU 13 can be transmitted to the LCD controller 7 at a higher speed.

Figure 3:
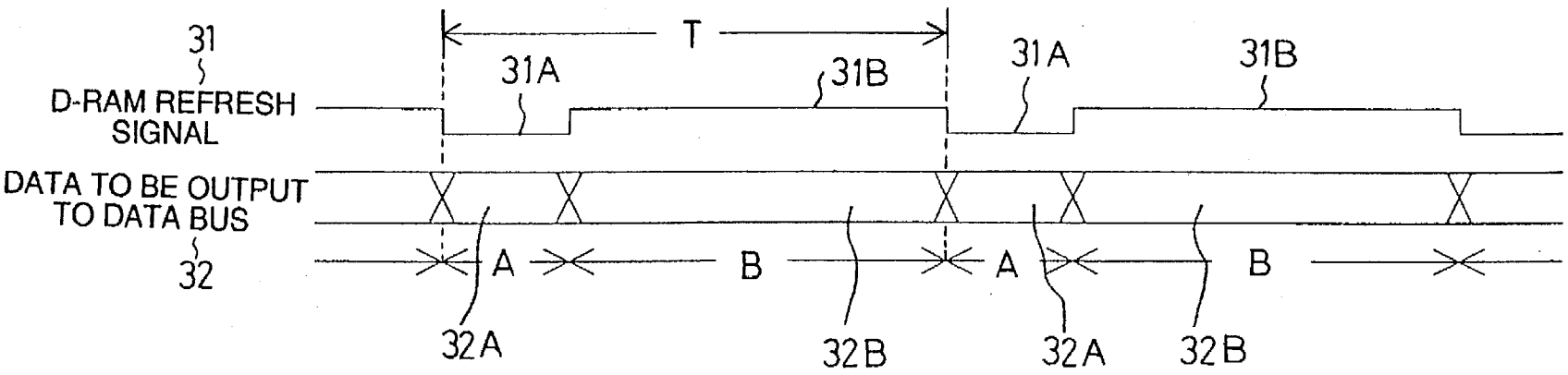
FIG. 3 is a time chart showing access of a RAM.
Figure 4:
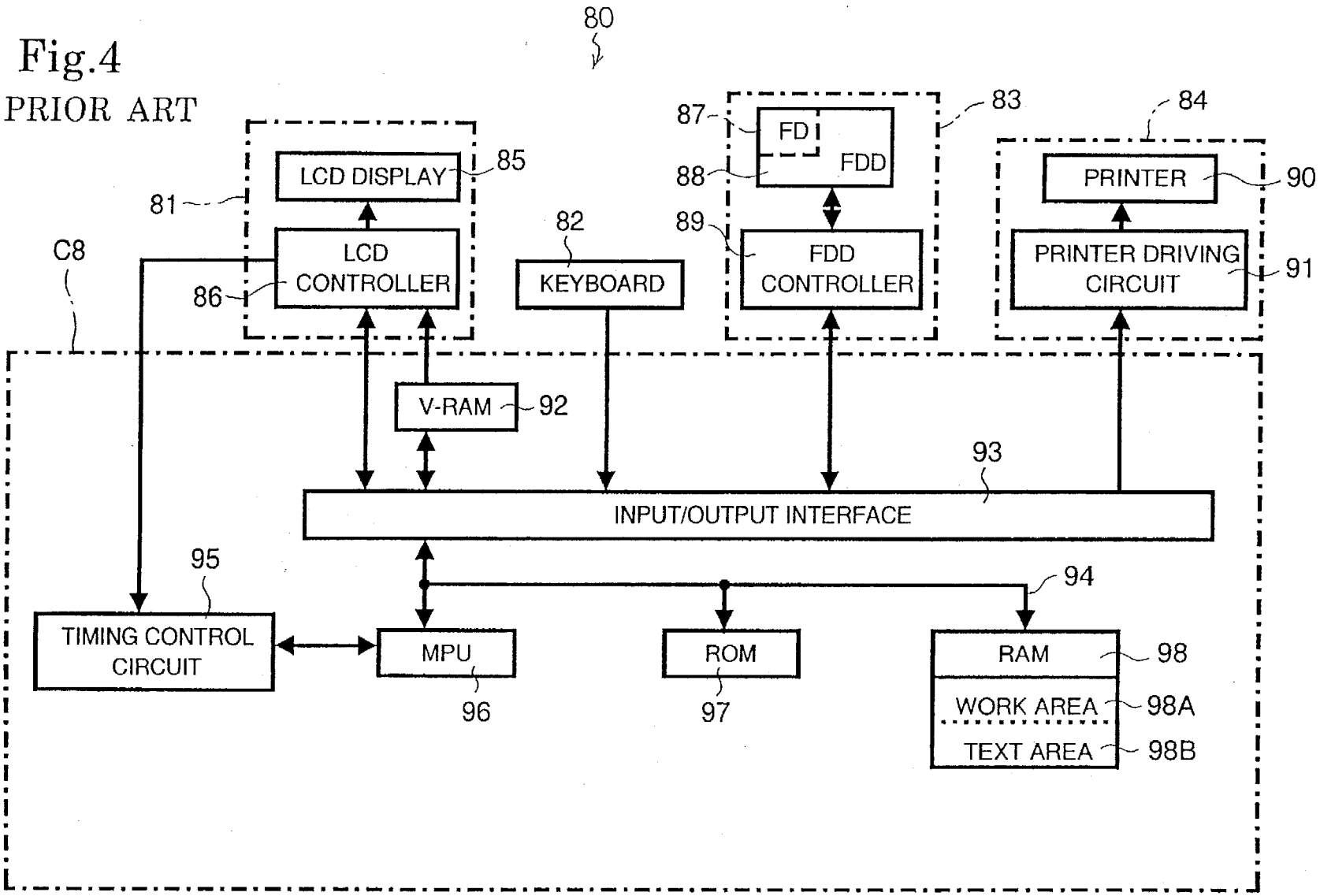
Fig.4 PRIOR ART
FIG. 4 is a block diagram showing the control system for a conventional word processor.

FIG. 3 is an access timing chart of the RAM 15. In FIG. 3, the D-RAM refresh signal 31 is output from the refresh signal generating circuit 13A. A period for which the refresh signal 31 is in a low-level state 31A corresponds to a refresh period, and a period for which the signal 31 is in a high-level state 31B corresponds to a command execution period of the MPU 13. The pulse duration is set to three states for each low-level pulse 31A and seven states for each high-level pulse 31B, that is, the pulse duration of each level pulse is set to be constant. Here, the term "state" means an operation unit of the MPU 13, and in this embodiment one state corresponds to 0.15 μs. The low-level pulses 31A and the high-level pulses 31B are repetitively and alternately output at a constant period T. That is, one period T corresponds to 10 states. The duration of each of the low-level pulse 31A and the high-level pulse 31B and the period T are variable in accordance with an operation clock of the MPU 13 or settings of an internal register.

Data 32 output to the data bus 18 are switched in accordance with the state of the refresh signal 31 of D-RAM. While the low-level pulses 31A are output, the data bus 18 is supplied with data 32A which are read out from the RAM 15 by the LCD controller 7. On the other hand, while the high-level pulses 31B are output, the data bus 18 is supplied with data 32B which are read out from or written in the RAM 15 by the MPU 13 or data 32B which are read out from the ROM 14 by the MPU 13.

In FIG. 3, period A represents a read-out period of display data by the LCD controller 7 (access period of the display area 15A by the LCD controller 7). Period B represents a data read-out and write-in period by the MPU 13 for each of the display area 15A, the work area 15B and the text area 15C of the RAM 15, and the access period of the ROM 14 by the MPU 13.

The period of the low-level pulse 31A of the D-RAM refresh signal 31 corresponds to the period A of FIG. 3, and the period of the high-level pulse 31B corresponds to the period B of FIG. 3. The sum of the periods A and B corresponds to the period T.

Next, the access operation of the MPU 13 and the LCD controller 7 to the RAM 15 in the word processor 1 thus structured will be described.

The MPU 13 periodically generates the D-RAM refresh signal 31 in the refresh signal generating circuit 13A which is built in the MPU 13 during the execution of the control program 14A. The operation clock and the internal register of the MPU 13 is set so that the signal producing period T and the periods A and B for the refresh signal 31 have time intervals which are conformed to the LCD controller 7. As the size of screen of the LCD display 10 increases and, thus, the display data becomes larger, the signal producing period T of the D-RAM refresh signal 31 is required to be shorter. In this case, although the display data are larger, a restriction is imposed on the maximum length of the period A, and thus a large amount of data are accessed for a constant period by shortening the period T.

Upon output of the D-RAM refresh signal 31 (signal of low level 31A), the MPU 13 sets the data bus 18 to the high-impedance state to interrupt the execution of the programs 14A and 14B, and transmits the signal to the refresh signal detection circuit 17. The refresh signal detection circuit 17 detects the trailing pulse (the pulse trailing edge) of the D-RAM refresh signal 31, and notifies the LCD controller 7 that the MPU 13 has set the data bus 18 to the high-impedance state. In response to this notification, the LCD controller 7 starts the read-out of the display data from the display area 15A of the RAM 15, and then outputs the read-out display data to the LCD display 10 for display.

Since the access time of the RAM 15 by the LCD controller 7 is set to be shorter than the period of the low level 31A of the D-RAM refresh signal 31, the LCD controller 7 is prevented from accessing the RAM 15 for a period exceeding the period of the low level 31A of the D-RAM refresh signal 31. Accordingly, even when the MPU 13 accesses the RAM 15 immediately after the output of the low level 31A of the D-RAM refresh signal 31 is finished, interference in the access to the RAM 15 between the MPU 13 and the LCD controller 7 is prevented.

On the other hand, while no D-RAM refresh signal 31 is output (during the period of the high level 31B), the MPU 13 inputs or outputs various kinds of data to or from the data bus 18. If occasion demands, it performs the data read-out and write-in operation for each area 15A to 15C of the RAM 15. Since the RAM 15 is not accessed by the LCD controller 7 while the refresh signal 31 of D-RAM is the high level 31B, interference in the access to the RAM 15 between the MPU 13 and the LCD controller 7 is prevented.

As described above, the refresh signal 31 of the D-RAM is periodically output, so that the MPU 13 periodically sets the data bus 18 to the high-impedance state to interrupt the execution of the programs 14A and 14B. However, the interruption is carried out for the constant period A at the period T. Therefore, the rate of the execution time B of the programs 14A and 14B to the overall time T, that is, the rate of the execution of the programs 14A and 14B is constant. Accordingly, when the soft timer program 14B is executed, a prescribed lapse time can be accurately counted at all times.

As is apparent from the foregoing, according to the word processor 1 of the embodiment, in response to the detection of the high-impedance state setting of the data bus 18 by the MPU 13, the display data are read out from the display area 15A of the RAM 15 by the LCD controller 7. Therefore, the MPU 13 and the LCD controller 7 are prevented from accessing the RAM 15 at the same time, so that erroneous data are prevented from being read out or written in and the disturbance of the display operation is also prevented. Accordingly, in the word processor 1 of the embodiment, the display area 15A for storing the display data and the work area 15B for storing the operation data can be contained in a one-chip RAM 15.

That is, since it is unnecessary to provide a V-RAM for display separately, the cost of the RAM 15 can be reduced and the print board can be miniaturized, so that the entire cost of the word processor can be reduced.

Further, the data bus 18 is set to the high-impedance state periodically and for a constant period, so that the MPU 13 can accurately count the prescribed time with the soft timer program 14B.

Still further, since the high-impedance state is performed using the refresh signal generating circuit 13A of the D-RAM which is built into the MPU 13, no special periodical signal generating circuit is required, and thus the electronic circuit can be simplified. The result is a further reduction in cost.

The invention was described with reference to the embodiment as described above, however, this invention is not limited to the above embodiment. Various modifications are expected to be applied to the above embodiment without departing from the subject matter of the invention.

For example, in the embodiment, the access of the MPU 13 and the LCD controller 7 to the RAM 15 is controlled using the D-RAM refresh signal 31, however, it may be controlled using another signal.

In the embodiment, the refresh signal generating circuit 13A is built into the MPU 13, however, it may be designed as an external circuit which is separated from the MPU 13. Further, the refresh signal detection circuit 17 is designed as a circuit which is separated from the LCD controller 7, however, it may be built into the LCD controller 7.

The RAM 15 of the embodiment is not necessarily formed of the D-RAM which needs a refresh operation, however, it may be formed of a S-RAM which needs no refresh operation.

What is claimed is:

1. A piece of electronic equipment having a display device, including:

control means for executing various processing;

display means for displaying characters or symbols;

data storing means for temporarily storing operation data used by said control means and display data of characters or symbols which are displayed on said display means;

a data bus for connecting said control means and said data storing means to perform the write-in and read-out operation of the data stored in said data storing means;

detection means for detecting that said control means sets the data bus to a high impedance state; and display control means which is connected through said data bus to said data storing means and reads out the display data stored in said data storing means in response to the detection of the high-impedance state of said data bus by said detection means, thereby controlling the display of the data on said display means.

2. The piece of electronic equipment as claimed in claim 1, further including signal generating means for generating a signal periodically, wherein said control means sets said data bus to the high-impedance state in response to the signal from said signal generating means.

3. The piece of electronic equipment as claimed in claim 2, further including a ROM storing a soft timer program for counting a desired time used by said control means.

4. The piece of electronic equipment as claimed in claim 3, Wherein the signal generated from said signal generating means is a D-RAM refresh signal.

5. The piece Of electronic equipment as claimed in claim 2, wherein the signal generated from said signal generating means is a D-RAM refresh signal.

6. The piece of electronic equipment as claimed in claim 4, wherein said signal generating means is built into said control means.

7. The piece of electronic equipment as claimed in claim 5, said data storing means comprises a D-RAM or a S-RAM.

8. The piece of electronic equipment as claimed in claim 5, wherein said data storing means comprises a one-chip RAM.

9. The piece of electronic equipment as claimed in claim 1, wherein said detection means detects the high-impedance state of said data bus by detecting the leading edge or trailing edge of a signal representing the high-impedance state of said data bus.

10. The piece of electronic equipment as claimed in claim 1, further including address signal selection means for selecting outputting to said data storing means one of an address signal output from said control means and an address signal output from said display control means, wherein said address signal selection means outputs the address signal of said display control means to said data storing means when receiving the signal representing the high-impedance state of said data bus to judge that said control means sets said data bus to the high-impedance state, and outputs the address signal of said control means to said data storing means in the other cases.

11. The piece of electronic equipment as claimed in claim 10, wherein said address signal selection means comprises a multiplexer.

12. The piece of electronic equipment as claimed in claim 1, wherein said detection means is built into said display control means.

13. The piece of electronic equipment as claimed in claim 1, wherein said data storing means has a display area where the display data are stored, a work area where the operation data are stored and a text area where document data are stored.

14. An access control system for a piece of electronic equipment having a display device, comprising:

a control unit;

a signal generator for outputting a signal;

a display controller;

a detection circuit for detecting the signal generated by said signal generator, said detection circuit electrically connected to said display controller;

a ROM containing at least one control program;

a RAM compartmented to contain at least a display area and a work area; and a data bus electrically connecting said control unit, said display controller, said ROM and said RAM, wherein said control unit sets said data bus to a high impedance state when the signal is output and at which time said display controller can communicate with said RAM and communications between said control unit and said RAM are interrupted.

15. The access control system as claimed in claim 14 further comprising a first address bus and a second address bus, wherein said first address bus is connected to at least said control unit and said ROM and said second address bus is connected to said display controller.

16. The access control system as claimed in claim 15, further comprising a multiplexer, wherein said multiplexer connects said first address bus to said RAM when the signal is not output and said second address bus to said RAM when the signal is output.

17. The access control system as claimed in claim 16, further comprising an input/output interface, wherein said second address bus is connected to said display controller through said input/output interface.

18. The access control system as claimed in claim 14, wherein said signal is periodically generated.

19. The access control system as claimed in claim 18, wherein said signal is a refresh signal.

20. The access control system as claimed in claim 19, wherein said ROM further contains at least one soft timer program.

* * * * *